United States Patent [19]

Maudlin et al.

[11] Patent Number: 4,903,629

[45] Date of Patent: Feb. 27, 1990

[54] BOAT SLIDE CHANNEL ASSEMBLY

[76] Inventors: Marla G. Maudlin; John C. Maudlin, both of 102 Crowley, Kemah, Tex. 77565

[21] Appl. No.: 294,382

[22] Filed: Jan. 6, 1989

[51] Int. Cl.[4] ..... B63B 17/00

[52] U.S. Cl. ..... 114/361; 24/462; 114/364; 160/352

[58] Field of Search ..... 114/221 R, 343, 361, 114/364; 24/587, 588, 462, 460; 160/391, 392, 395; 248/316.7, 273

[56] References Cited

U.S. PATENT DOCUMENTS

| | | | |
|---|---|---|---|
| 3,371,702 | 3/1968 | Keegan et al. | 160/395 |
| 3,473,836 | 10/1969 | Halter | 114/219 X |
| 4,103,401 | 8/1978 | Conley | 24/462 |
| 4,292,913 | 10/1981 | Siebert et al. | 114/361 X |

*Primary Examiner*—Sherman D. Basinger

*Attorney, Agent, or Firm*—Arnold, White & Durkee

[57] ABSTRACT

A boat slide channel assembly for use in the installation of marine canvas products has a slide channel member of a one-piece PVC extrusion having a mounting base and upwardly projecting sidewalls which form a groove track located substantially directly over the mounting base. The slide channel member easily fits to a multi-facet surface.

13 Claims, 1 Drawing Sheet

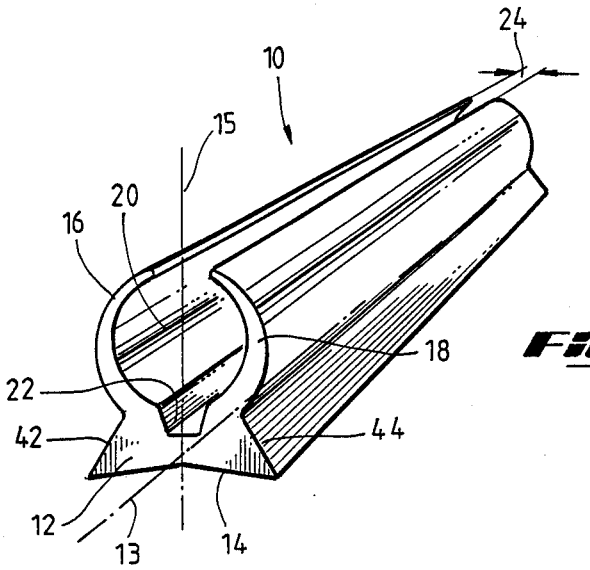
Fig. 1
Fig. 2A
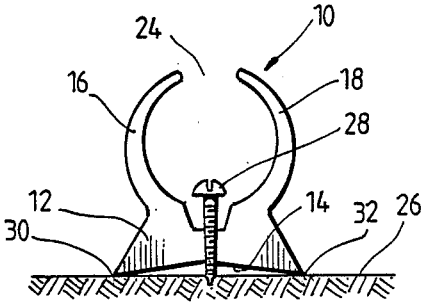
Fig. 2B
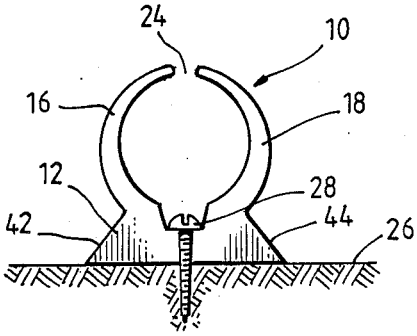
Fig. 3
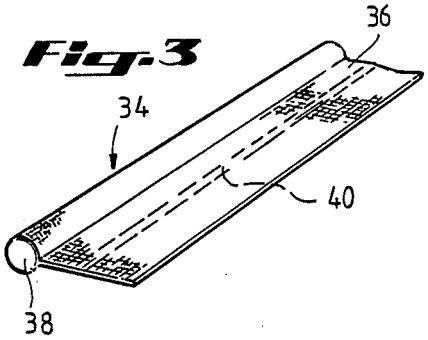
Fig. 4
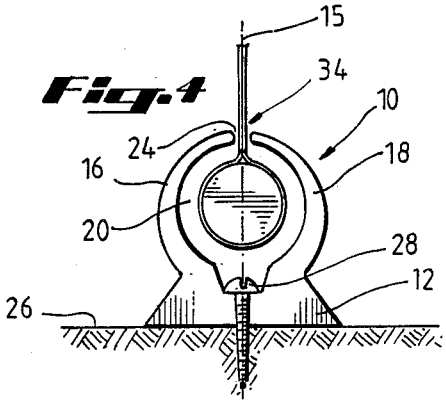

BOAT SLIDE CHANNEL ASSEMBLY

BACKGROUND OF THE INVENTION

The present invention relates to boat slide channel parts and assemblies useful in the installation or construction of marine canvas products such as dodgers, awnings, biminis, etc.

In the installation of marine canvas products, there is the need to secure the canvas fabric of the product to the surface of a vessel. For example, in the installation of a dodger or spray hood on a sail or power boat, there is a metal framework covered with canvas to form roof and sidewall portions. Typically, also, there is clear vinyl side and front windows for visibility from the cockpit. The canvas sidewalls require some form of attachment to the deck surface. Traditional dodgers are attached using snaps or twist fasteners. However, this type of attachment does not seal against water leakage, and it pulls or stretches the fabric at the attachment points.

Another type of attachment is the slide channel assembly. This type of attachment has a mounting flange and an offset groove for receiving a sliding insert sewn to the fabric. The flange is affixed to the deck surface. The coupling of the sliding insert in the groove serves to attach the fabric to the deck surface.

The flanged attachment, however, presents formidable problems in many canvas product installations. For example, a dodger installation around the cockpit of a boat requires the sidewalls to bend around curves. Flanged attachments do not easily conform to such curves; and require a "v" shaped notch in the flange in order to allow it to bend in an arc or around a corner. This shaping of the flanged attachment is not only a time-consuming and expensive operation; it results in an unattractive installation. Particularly if the flanged attachment is made of aluminum, there is great risk of kinking the material when attempting to fit it around a curve. If there is kinking, the material must be scrapped.

The flanged attachment also presents problems in affixing it to a deck surface. The attachment is affixed by screwing only the flange into place against the deck surface. The load-bearing groove is thereby left unsupported. This results in the groove being pulled away from the surface. There is great risk of failure, particularly if made of plastic, due to the unsupported load-bearing groove.

SUMMARY OF THE INVENTION

In accordance with the present invention, an attachment mechanism for marine canvas products is provided. The attachment mechanism comprises a slide channel member having a groove for receiving a slide insert. The slide channel member is an elongated extrusion of a flexible material having an underside base with a surface to be mounted against the surface of a deck and having first and second spaced apart sidewalls projecting from the base to form a groove track extending longitudinally of the base and adapted to receive a slide insert. The sidewalls project substantially perpendicular to the mounting base and are positioned laterally so as to locate the groove track substantially directly over the longitudinal centerline axis of the mounting base.

The present invention provides a flangeless, flexible grooved extrusion for use in a boat slide channel assembly which easily fits to a multi-facet surface. When the slide insert, such as a bolt rope sewn onto the fabric covering, is slid into the groove, there results a smooth and even connection.

Further in accordance with the invention, the mounting base may include a counter sink area formed at the bottom of the groove track between the sidewalls and extending longitudinally. The counter sink area is adapted to receive therethrough a screw for affixing the base to a deck surface. The mounting surface of the base may also be of a concave configuration.

In accordance with yet a further aspect of the invention, the sidewalls forming the groove track define a slot opening of a first width dimension prior to installation and define a slot opening of a second and smaller width dimension after installation. Movement of the sidewalls to reduce the opening width assures a good hold of the slide insert and results from the force of mounting the base against the deck surface.

Further aspects of the present invention can be ascertained from the detailed written description which follows.

DESCRIPTION OF THE DRAWINGS

A written description setting forth the best mode presently known for carrying out the present invention, and of the manner of implementing and using it, is provided by the following detailed description of a preferred embodiment which is illustrated in the attached drawings wherein:

FIG. 1 is a perspective view of a section of a slide channel member in accordance with the present invention;

FIGS. 2A and 2B are transverse cross-section views of the slide channel member of FIG. 1, which views illustrate the installation of the slide channel member;

FIG. 3 is a perspective view of a slide insert for use with the slide channel member of FIG. 1; and FIG. 4 is a end view of an installed slide channel member having a slide insert positioned therein.

DESCRIPTION OF AN ILLUSTRATIVE EMBODIMENT

In FIG. 1, there is shown a slide channel member 10 in accordance with the present invention. It will be appreciated that in FIG. 1 there is only a segment of slide channel member 10 is shown. Slide channel member 10 is an elongated extrusion of a flexible material. The member includes a base 12 with an underside 14 to be mounted against the surface of a deck. Member 10 further includes first and second sidewalls 16 and 18 projecting from base 12 to form a groove track 20 extending longitudinally of the base and adapted to receive a slide insert. The sidewalls 16 and 18 extend substantially perpendicular to the mounting surface 14 of base 12 so as to locate the groove track substantially directly over the mounting base and generally in vertical alignment with the centerline axis 13.

The mounting base 12 may include a countersink area 22 formed at the bottom of the groove track between the sidewalls and extending longitudinally of member 10. The countersink area 22 is adapted to receive therethrough a screw for affixing the base 12 to a deck surface. As shown in FIG. 1, the mounting surface 14 of base 12 is preferably of a concave figuration. In the illustrated embodiment, sidewalls 16 and 18 are of an arcuate configuration. It will be appreciated, however, that the exact geometric contour or configuration of sidewalls 16 and 18 may be modified to another configuration. The requirement for sidewalls 16 and 18 is merely that they place groove track 20 in substantial alignment with mounting base 12 and that a groove track opening 24 of substantially uniform width be established.

With regard to the extrusion material for slide channel member 10, Applicants have found that a general purpose, high impact rigid PVC extrusion compound is preferred. One such material is GEON 87256 which is available from The B.F. Goodrich Company, Chemical Group, 6100 Oak Tree Boulevard, Cleveland, OH 44131.

Continuing with reference now to FIGS. 2A and 2B, installation of slide channel member 10 is shown. In FIG. 2A, slide channel member 10 is shown being placed against a deck surface 26. A screw 28 is driven through base 12 and into deck surface 26. Specifically, it will be noted that screw 28 is driven through the portion of mounting base 12 in which countersink area 22 is formed. As further shown in FIG. 2A, groove track opening 24 permits screw 28 and a screwdriver mechanism for turning screw 28 to gain access to the interior of groove track 20 between sidewalls 16 and 18. Also, it is to be noted that concaved mounting surface 14 initially has a centralized portion thereof raised off deck surface 26. That is, only the longitudinal peripheral side edges 30 and 32 are initially in contact with deck surface 26. When screws 28 are driven into deck 26, the concave underside 14 deflects into a substantially planar surface.

Referring now to FIG. 2B, slide channel member 10 is shown in the fully installed position wherein screw 28 has been fully driven into countersink area 22. In the fully installed position, mounting surface 14 is forced into substantially complete engagement with deck surface 26. In forcing mounting surface 14 into substantially complete contact with deck surface 26, sidewalls 16 and 18 are caused to deflect inwardly. This inward deflection of the sidewalls causes groove track opening 24 to be reduced in width. Therefore, it will be observed that the sidewalls 16 and 18 form a slot opening of a first width dimension prior to installation and define a slot opening of a second and smaller width dimension after installation. The force of screwing the mounting base against the deck 26 also forces the base to deform and move the distal ends of the sidewalls closer together.

Based upon FIGS. 2A and 2B, it will be appreciated that slide channel member 10 is easily installed by screwing a small flat head phillips screw directly through the groove extrusion and into the deck surface. Further, it will be appreciated that unlike the prior art flanged attachments, slide channel member 10 places the load-bearing groove track in substantial alignment with the mounting base and the fastener which secures the mounting base to the deck surface Slide channel member 10 provides a smooth continuous groove for receiving a slide insert which is sewn onto the fabric covering of the marine canvas product. Referring to FIG. 3, a slide insert 34 in the form of a bolt rope is shown. Canvas fabric 36, for example, is wrapped around a substantially cylindrical core member 38 and then sewn together along a line 40. The resulting tab can in turn be sewn to a larger piece of fabric as desired.

Referring now to FIG. 4, slide insert 34 is shown in its inserted position within groove track 20. The tab portion of slide insert 34 extends through slide opening 24. The fabric wrapped core 38 is retained within groove track 20. Together, slide channel member 10 and slide insert 34 provide a slide channel member assembly.

It will be appreciated that slide channel member 10 may be easily installed to fit a multi-facet surface. Specifically, slide channel member 10 may be bent along its longitudinal axis in a plane parallel to mounting surface 14 to provide a curved groove track. Further, slide channel member 10 locates the axis of force between the marine product and the deck surface along a line that extends through the point of mounting attachment between the slide channel member and the deck surface. This is illustrated in FIG. 1 and FIG. 4 by the dashed line designated as Force Axis 15.

The description of the preferred embodiment has been for purpose of explanation and illustration. It will be appreciated by those skilled in the art that many modifications and changes can be made in the structure of slide channel member 10 without departing from the essence of the present invention. Therefore, it is contemplated that the appended claims will cover any modifications or embodiments which fall within the scope of the invention.

In this regard, it will be appreciated that slide channel member 10 could be readily modified in the cross-sectional configuration of the extrusion to include a different configuration for mounting base 12 and mounting surface 14. Although Applicants believe substantial advantage is obtained by using the configuration of mounting base 12 provided by sloping convergent sidewalls 42 and 44, other orientations for sidewalls 42 and 44 could be utilized. Similarly, although concave mounting surface 14 is believed to provide substantial advantage, a planar or other configuration could be provided for mounting surface 14. These and other modifications to the illustrated construction of slide channel member 10 are believed by Applicants to be within the scope of the invention and covered by the appended claims.

What is claimed is:

1. A slide channel member for attaching a marine canvas product to a deck surface, comprising:

an elongated body of flexible material having a mounting base with an underside surface to be mounted against a deck surface;

said body having a pair of spaced apart sidewalls extending longitudinally of the mounting base to form a groove track adapted to receive a slide insert;

said sidewalls projecting from the mounting base in an orientation substantially perpendicular to the mounting base and being laterally positioned to locate the groove track substantially directly over the longitudinal centerline axis of the mounting base;

said underside surface of the mounting base having a concave shape transverse to the longitudinal axis of the body and adapted to deform into a substantially planar surface upon installation against a deck surface.

2. A slide channel member for attaching a marine canvas product to a deck surface, comprising:

an elongated body of flexible material having a mounting base with an underside surface to be mounted against a deck surface;

said body having a pair of spaced apart sidewalls extending longitudinally of the mounting base to form a groove track adapted to receive a slide insert;

said sidewalls projecting from the mounting base in an orientation substantially perpendicular to the mounting base and being laterally positioned to locate the groove track substantially directly over the longitudinal centerline axis of the mounting base;

said mounting base having sloping side surfaces extending longitudinally, the sloping side surfaces being convergent from the longitudinal peripheral edges of the underside surface toward the projecting sidewalls, and wherein the underside surface of the mounting base has a concave shape transverse to the longitudinal axis of the body and adapted to deform into a substantially planar surface upon installation against a deck surface.

3. A slide channel member for attaching a marine canvas product to a deck surface, comprising:

an elongated body of flexible material having a mounting base with an underside surface to be mounted against a deck surface;

said body having a pair of spaced apart sidewalls extending longitudinally of the mounting base to form a groove track adapted to receive a slide insert;

said sidewalls projecting from the mounting base in an orientation substantially perpendicular to the mounting base and being laterally positioned to locate the groove track substantially directly over the longitudinal centerline axis of the mounting base;

said projecting sidewalls having distal ends that form a slot opening extending along the length of the body, the distal ends of the sidewalls assuming a separation distance prior to installation of the mounting base that provides a first slot width dimension and assuming a separation distance after installation of the mounting base that provides a second, smaller slot width dimension.

4. The slide channel member of claims 1, 2 or 3 wherein the mounting base and the sidewalls are formed as a one-piece extrusion.

5. The slide channel member of claims 1, 2 or 3 wherein the mounting base has a countersink area located at the bottom of the groove track between the sidewalls and extending longitudinally of the base, the countersink area being adapted to receive therein a fastener for affixing the base to a deck surface.

6. The slide channel member of claims 1, 2 or 3 wherein the underside surface of the mounting base has a concave shape transverse to the longitudinal centerline axis of the base.

7. The slide channel member of claims 1, 2 or 3 wherein the projecting sidewalls are of an arcuate cross-sectional configuration to form a groove track of a substantially circular cross-sectional configuration.

8. The slide channel member of claims 1, 2 or 3 wherein the body of flexible material is a polyvinyl chloride compound.

9. A slide channel member assembly for attaching a marine canvas product to a deck surface, comprising:

an elongated body of flexible material having a mounting base with an underside surface to be mounted against a deck surface and a pair of spaced apart sidewalls extending longitudinally of the mounting base to form a groove track adapted to receive a slide insert;

said sidewalls projecting from the mounting base in an orientation substantially perpendicular to the mounting base and being laterally positioned to locate the groove track substantially directly over the longitudinal centerline axis of the mounting base;

said mounting base having sloping side surfaces extending longitudinally thereof and being convergent from the longitudinal peripheral edges of the underside surface toward the projecting sidewalls;

said mounting base having a countersink area located between the projecting sidewalls and at the bottom of the groove track, the countersink area extending longitudinally of the base and adapted to receive therein a screw for affixing the base to a deck surface;

said underside surface of the mounting base having a concave shape transverse to the longitudinal axis of the base;

said projecting sidewalls having distal ends extending substantially parallel to form a slot opening to the groove track that extends along the length of the body, the distal ends of the sidewalls assuming a separation distance prior to installation of the mounting base that provides a first slot width dimension; and said mounting base being deformable upon installation by the force of a screw applied through the countersink area such that the underside concave surface deflects to form a substantially planar surface against a deck surface and such that the distal ends of the projecting sidewalls are moved closer together to assume a separation distance that provides a second, smaller width dimension.

10. The slide channel member assembly of claim 9 wherein the elongated body includes the mounting base and the sidewalls in a one-piece extrusion.

11. The slide channel member assembly of claim 9 wherein the projecting sidewalls are of an arcuate cross-sectional configuration to form a groove track of a substantially circular cross-sectional configuration.

12. The slide channel member assembly of claim 9 wherein the body of flexible material is a polyvinyl chloride compound.

13. The slide channel member assembly of claim 9, further comprising: a slide insert adapted to be received within the groove track.

* * * * *